US010077779B2

(12) United States Patent
Klusacek

(10) Patent No.: US 10,077,779 B2
(45) Date of Patent: Sep. 18, 2018

(54) ROTOR OF A SUPERCHARGING DEVICE

(71) Applicant: Bosch Mahle Turbo Systems GmbH & Co. KG, Stuttgart (DE)

(72) Inventor: Michal Klusacek, Praha (CZ)

(73) Assignee: Bosch Mahle Turbo Systems GmbH & Co. KG (DE)

( * ) Notice: Subject to any disclaimer, the term of this patent is extended or adjusted under 35 U.S.C. 154(b) by 542 days.

(21) Appl. No.: 14/675,724

(22) Filed: Mar. 31, 2015

(65) Prior Publication Data

US 2015/0275903 A1 Oct. 1, 2015

(30) Foreign Application Priority Data

Apr. 1, 2014 (DE) ..... 10 2014 206 159
Feb. 12, 2015 (DE) ..... 10 2015 202 558

(51) Int. Cl.
*F04D 25/04* (2006.01)
*F01D 5/02* (2006.01)
(Continued)

(52) U.S. Cl.
CPC ..... *F04D 25/045* (2013.01); *F01D 5/026* (2013.01); *F04D 19/024* (2013.01);
(Continued)

(58) Field of Classification Search
CPC ... F01D 5/02; F01D 5/048; F02C 6/12; F05D 2220/40; F05D 2240/20; F05D 2250/241;
(Continued)

(56) References Cited

U.S. PATENT DOCUMENTS 1,959,703 A 5/1934 Birmann
2,297,508 A * 9/1942 Schutte ..... F01D 5/021 415/200
(Continued)

FOREIGN PATENT DOCUMENTS

DE 1575700 A1 12/1970
DE 20009004 U1 8/2000
(Continued)

OTHER PUBLICATIONS

English abstract for DE-102008048135.
(Continued)

*Primary Examiner* — Igor Kershteyn
*Assistant Examiner* — Eric Zamora Alvarez
(74) *Attorney, Agent, or Firm* — Fishman Stewart PLLC

(57) ABSTRACT

A rotor for a supercharging device may include a compressor wheel and a turbine wheel. A sealing disc may be arranged between the compressor wheel and the turbine wheel. The sealing disc may include a first side interfacing with the compressor wheel and a second side interfacing with the turbine wheel. The compressor wheel and the turbine wheel may each define one of a holding contour and a counter-holding contour, which respectively interact with a corresponding one of a holding contour and a counter-holding contour defined on each of the first side and the second side of the sealing disc. The respective holding contour may correspond to the respective counter-holding contour, which may engage in one another and secure the compressor wheel, the sealing disc and the turbine wheel to one another.

20 Claims, 2 Drawing Sheets

(51) Int. Cl.

| | |
|---|---|
| ***F04D 29/053*** | (2006.01) |
| ***F04D 25/02*** | (2006.01) |
| ***F04D 29/08*** | (2006.01) |
| ***F04D 19/02*** | (2006.01) |

(52) U.S. Cl.
CPC ..... *F04D 25/024* (2013.01); *F04D 29/053* (2013.01); *F04D 29/083* (2013.01); *F05D 2220/40* (2013.01); *F05D 2250/241* (2013.01); *F05D 2260/36* (2013.01); *F05D 2260/37* (2013.01)

(58) Field of Classification Search
CPC ..... F05D 2260/36; F05D 2260/37; F05D 2300/133; F05D 2300/611
See application file for complete search history.

(56) References Cited

U.S. PATENT DOCUMENTS

| | | | | | |
|---|---|---|---|---|---|
| 2,938,659 | A * | 5/1960 | Judson | F01D 5/043 | 415/177 |
| 3,326,453 | A | 6/1967 | Kun | | |
| 3,692,436 | A * | 9/1972 | Connor | F01D 5/043 | 417/406 |
| 4,034,560 | A | 7/1977 | Chute | | |
| 4,472,107 | A * | 9/1984 | Chang | F01D 3/04 | 415/104 |
| 4,722,630 | A * | 2/1988 | Fang | F01D 5/025 | 228/138 |
| 4,786,238 | A * | 11/1988 | Glaser | F01D 25/125 | 415/175 |
| 4,798,320 | A * | 1/1989 | Fang | F01D 5/025 | 228/124.1 |
| 4,991,991 | A * | 2/1991 | Ito | C04B 37/005 | 403/272 |
| 5,248,239 | A * | 9/1993 | Andrews | F01D 3/00 | 415/104 |
| 6,499,969 | B1 * | 12/2002 | Tombers | F01D 5/025 | 416/204 A |
| 2013/0209267 | A1 | 8/2013 | Klusacek | | |
| 2013/0272854 | A1 * | 10/2013 | Schmidt | F01D 25/16 | 415/170.1 |

FOREIGN PATENT DOCUMENTS

| | | | |
|---|---|---|---|
| DE | 102008048126 | A1 | 3/2010 |
| DE | 102008048135 | A1 | 3/2010 |
| DE | 102009014005 | A1 | 9/2010 |
| DE | 102012202272 | A1 | 8/2013 |
| GB | 563918 | A | 9/1944 |

OTHER PUBLICATIONS

English Abstract for DE-102008048126-A1.
English Abstract for DE-102009014005-A1.
Bibliographic Data Sheet Indicating No Abstract Available for DE-20009004-U1.
German Search Report App. No. 102015202558.6 dated Oct. 14, 2015.

* cited by examiner

ROTOR OF A SUPERCHARGING DEVICE

CROSS-REFERENCE TO RELATED APPLICATIONS

This application claims priority to German Patent Application No. 10 2014 206 159.8, filed Apr. 1, 2014, and German Patent Application No. 10 2015 202 558.6, filed Feb. 12, 2015, both of which are hereby incorporated by reference in their entirety.

TECHNICAL FIELD

The present invention relates to a rotor of a supercharging device, in particular of an exhaust gas turbocharger. The invention additionally relates to a supercharging device having such a rotor.

BACKGROUND

From DE 10 2012 202 272 A1 a generic rotor of a supercharging device with a compressor wheel and a turbine wheel fastened thereon is known. Between the compressor wheel and the turbine wheel a heat shield is arranged, which subdivides a hollow space that exists between the compressor wheel and the turbine wheel into two hollow spaces. In these two hollow spaces a sub-pressure, in particular a vacuum, is provided, so that the turbine wheel solely because of the vacuum is held on the compressor wheel by way of the heat shield.

From DE 10 2008 048 135 A1 an exhaust gas turbocharger is known, which comprises a particular rotor geometry which is designed in such a manner that vibrations excited by the rotor are in a sub-critical frequency range. This serves to achieve that resonances do not become problematic up to the strength limit of the rotor.

Generally, a rotor of a supercharging device, for example of an exhaust gas turbocharger, usually consists of a compressor wheel, a shaft and a turbine wheel. This applies in particular to such embodiments in which the rotor via the shaft is located in a bearing housing that is located between a turbine housing respectively a compressor housing. A connection between the turbine wheel respectively the compressor wheel and the shaft is often effected by means of welding, which is advantageous in particular in the case of thin shafts. In the case of thicker shafts or in the case of a compressor wheel arranged directly on the turbine wheel welding however is not possible or only to a limited extent. For this reason, fastening of the turbine wheel to the compressor wheel by means of sub-pressure is recommended for example in DE 10 2012 202 272 A1. Disadvantageous with such an embodiment however is that with a diminishing sub-pressure there is the risk of the turbine wheel detaching from the compressor wheel and thus the risk of the rotor breaking apart, which because of the high rotational speeds of the rotor often results in a total destruction of the supercharging device.

SUMMARY

The present invention therefore deals with the problem of stating an improved or at least an alternative embodiment for a rotor of the generic type, which ensures a reliable connection between turbine wheel and compressor wheel.

According to the invention, this problem is solved through the subject of the independent claims. Advantageous embodiments are subject of the dependent claims.

The present invention is based on the general idea of fastening a turbine wheel of a rotor to a compressor wheel of the rotor indirectly via a sealing disc, wherein the compressor wheel and the turbine wheel each have a holding contour and the sealing disc a counter-holding contour designed complementarily thereto, or vice versa. Alternatively to this it can also be provided that the sealing disc comprises a central counter-holding contour and located opposite a central holding contour and the compressor wheel and the turbine wheel in each case have a holding contour or a counter-holding contour that is designed complementarily thereto. Both embodiments have in common that the holding contour and the counter-holding contour in the assembled state engage in one another and in addition fasten the compressor wheel, the sealing disc and the turbine wheel to one another. Here, the holding contour is designed as a recess, whereas the counter-holding contour is designed as an extension designed complementarily thereto, or vice versa.

Practically, the compressor wheel and the turbine wheel comprise central recesses each facing one another. The sealing disc in turn comprises two extensions located axially opposite and projecting centrally, so that with its extensions it engages in the central recess of the compressor wheel and of the turbine wheel and thereby fastens these to one another. Alternatively to this it is conversely also conceivable that the compressor wheel and the turbine wheel each comprise central extensions facing one another, wherein in this case the sealing disc arranged between the compressor wheel and the turbine wheel has two central recesses located axially opposite. By the compressor wheel and the turbine wheel engaging with its central extensions in the central recesses of the sealing disc fastening of the components to one another can be likewise achieved—exact conversely in this case. The central recesses and the associated central axial extensions in this case do not only offer the possibility of an optimised connection of the individual parts to one another, in particular in the case of thicker shafts, but also a centring function at the same time. The embodiment described as second alternative additionally offers the major advantage that the extension on the turbine wheel heats up during the operation of the exhaust gas turbocharger and thereby expands which leads to a clamping and additional fixing in the recess of the sealing disc.

Again, alternatively, it can be provided that the sealing disc comprises a central extension and a central recess and that the compressor wheel comprises a recess that is designed complementarily thereto or an extension that is designed complementarily thereto and the turbine wheel comprises a recess that is designed complementarily thereto or an extension that is designed complementarily thereto and are thereby fastened to one another. Particularly favourable in this case is the alternative in which on the turbine wheel an extension and on the sealing disc an associated recess and on the compressor wheel a recess and located opposite on the sealing disc an associated extension are formed, since the extension on the turbine wheel heats up during the operation of the exhaust gas turbocharger and expands because of this which leads to a clamping and additional fixing in the recess of the sealing disc and simultaneously transfers the heat to the sealing disc and the extension facing the compressor wheel of said sealing disc, so that said extension can brace itself in the recess on the compressor wheel.

With an advantageous further development of the solution according to the invention, the extensions of the sealing disc comprise an external thread and the associated recesses in the compressor wheel or the turbine wheel have an internal thread designed complementarily thereto, so that the compressor wheel via the sealing disc can be screwed to the turbine wheel. Because of this a comparatively simple assembly of the rotor according to the invention can be achieved, wherein via the thread connection, i.e. the screw connection of the sealing disc both to the compressor wheel and also to the turbine wheel a reliable and durable connection can be created. A major advantage with this type of connection furthermore is that the same can be disconnected again for example for maintenance purposes. Analogously, the extensions comprising the external thread can also be arranged on the compressor wheel and/or on the turbine wheel and the associated internal threads on the sealing disc. It is also conceivable that on the turbine wheel an extension with external thread is provided, which can be screwed into an internal thread on the sealing disc, wherein on the side of the sealing disc facing the compressor wheel an extension comprising an external thread is provided, which can be screwed into an internal thread on the compressor wheel.

In a further alternative embodiment of the solution according to the invention, the extensions of the sealing disc are designed crowned or comprise a ball joint head, and thereby engage in the recesses of the compressor wheel respectively of the turbine wheel designed complementarily thereto. Because of this a connection in the manner of an articulated snap connection is possible, wherein in the recess on the turbine wheel respectively on the compressor wheel an undercut contour corresponding to the extension is provided. Assembling the rotor in this case is simply effected by pressing the respective extension into the associated recess on the compressor wheel respectively on the turbine wheel until the ball head or the extension of crowned design engages in the undercut contour on the turbine wheel respectively on the compressor wheel. In the same simple manner, the rotor, i.e. the individual parts of the same, can also be again detached from one another.

With a further advantageous alternative of the solution according to the invention, the extensions of the sealing disc are pressed into the associated recesses of the compressor wheel respectively of the turbine wheel or vice versa. Here it is conceivable that the extension with oversize is pressed into the respective recess, in particular of the compressor wheel respectively of the turbine wheel and the fixed connection between sealing disc and compressor wheel respectively turbine wheel established.

Obviously, a combination of individual connection possibilities described in the previous paragraphs is also conceivable so that for example the sealing disc can be screwed to the compressor wheel and pressed together with the turbine wheel via an extension.

Further important features and advantages of the invention are obtained from the subclaims, from the drawings and from the associated figure description with the help of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

Here it shows, in each case schematically.

DETAILED DESCRIPTION

Figure 1:
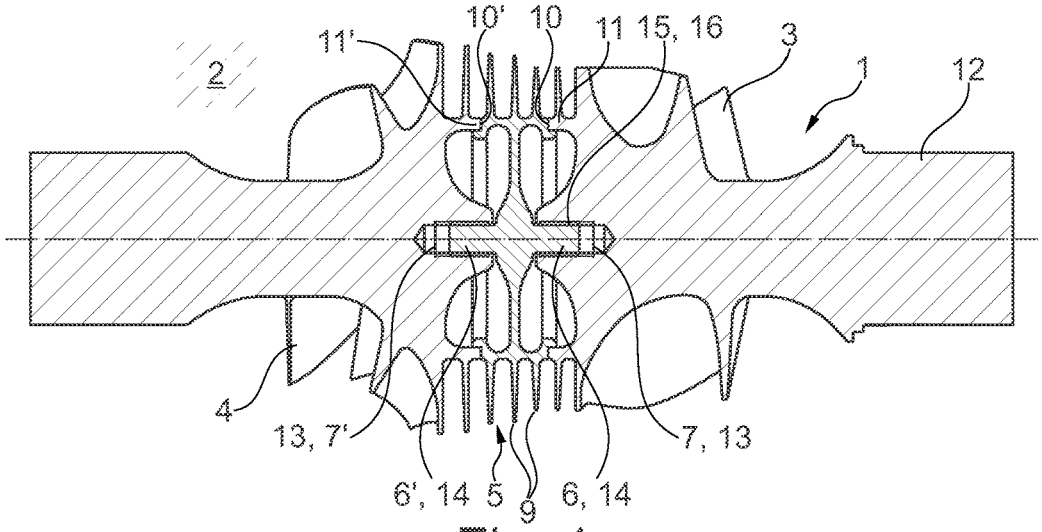
FIG. 1 a sectional representation through a rotor according to the invention, FIG. 2 a representation as in FIG. 1, however with another type of connection between sealing disc and compressor wheel respectively turbine wheel, FIG. 3 a detail representation from FIG. 2 in the region of the connection of the sealing disc to the compressor wheel respectively turbine wheel, FIG. 4 a representation as in FIG. 1, however with extensions and recesses arranged conversely, FIG. 5 a representation as in FIG. 4, however with extension and recess conversely on the compressor side, FIG. 6 a representation as in FIG. 4, however with extension and recess conversely on the turbine side.

According to the FIGS. 1 to 4, a rotor 1 according to the invention of a supercharging device 2 which is merely shown in outline, which in particular can be designed as an exhaust gas turbocharger, comprises a compressor wheel 3 and a turbine wheel 4 connected thereto. The compressor wheel 3 and the turbine wheel 4 each have a holding contour 13 and the sealing disc 5 a counter-holding contour 14 formed complementarily thereto, or vice versa (see FIG. 4). With the embodiments shown in FIGS. 5 and 6, the sealing disc 5 comprises a central counter-holding contour 14 and located opposite a central holding contour 13 and the compressor wheel 3 and the turbine wheel 4 each comprise a holding contour 13 or a counter-holding contour 14 each formed complementarily thereto. All shown embodiments in this case have in common that the holding contour 13 and the counter-holding contour 14 engage in one another in the assembled state and in addition fasten the compressor wheel 3, the sealing disc 5 and the turbine wheel 4 to one another.

Independently of the selected embodiment, the holding contour 13 is designed as a central recess 7, 7', 7", 7'", whereas the counter-holding contour 14 is designed as a centrally projecting extension 6, 6', 6", 6'".

Figure 2:
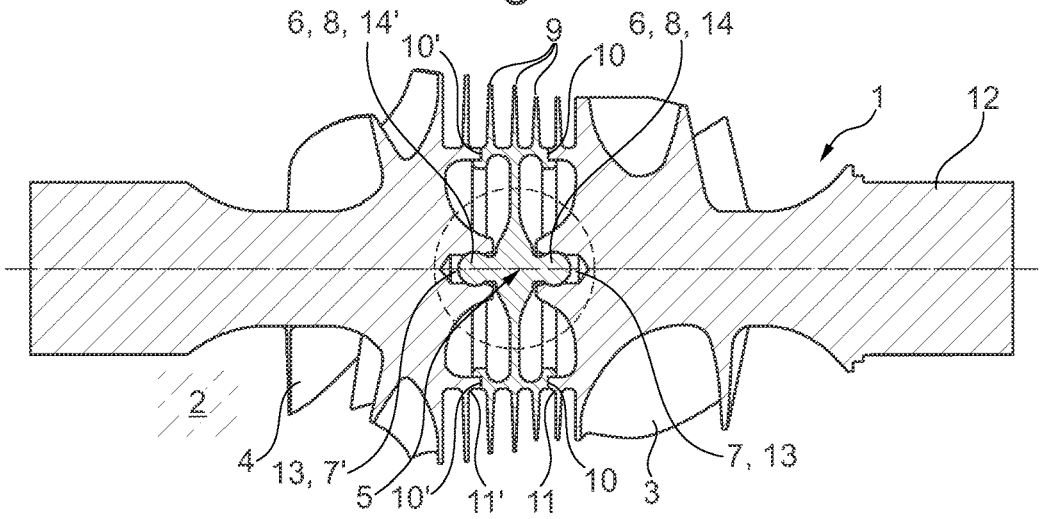
Figure 3:
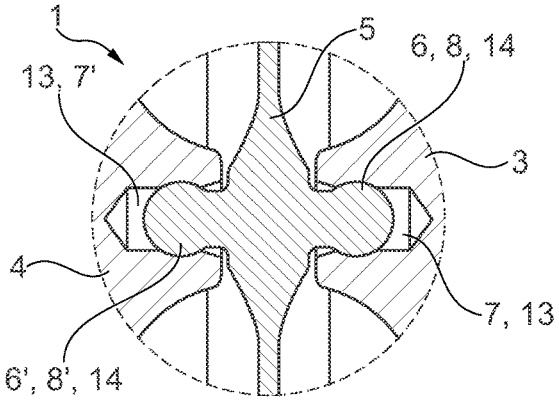
Figure 4:
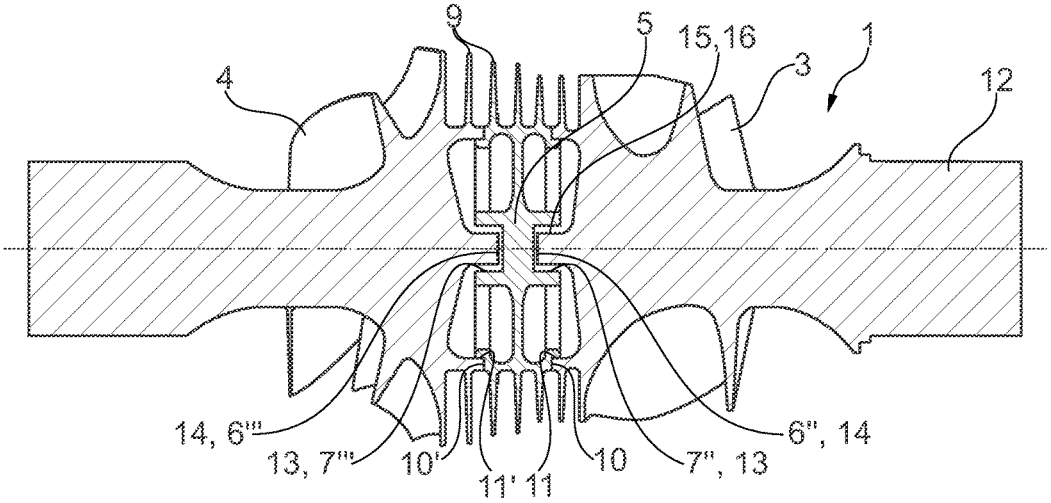

According to FIGS. 1 to 3, a sealing disc 5 is arranged between the compressor wheel 3 and the turbine wheel 4, which comprises two centrally projecting extensions 6, 6' located axially opposite as counter-holding contour 14. The compressor wheel 3 and the turbine wheel 4 by contrast each have a central recess 7, 7' facing one another as holding contour 13, wherein the sealing disc 5 with its extensions 6, 6' engages in the central recess 7, 7' of the compressor wheel 3 and of the turbine wheel 4 and thereby fastens these to one another. FIG. 4 shows a converse, alternative embodiment, with which the compressor wheel 3 and the turbine wheel 4 each comprise central extensions 6", 6'" facing one another as counter-holding contour 14. Between the compressor wheel 3 and the turbine wheel 4 a sealing disc 5 is again arranged which now however comprises two central recesses 7", 7'" located axially opposite and designed as holding contour 13. The compressor wheel 3 and the turbine wheel 4 engage with their central extensions 6", 6'" in the central recesses 7", 7'" of the sealing disc 5. Thus, FIG. 4 is an inverted embodiment with respect to FIGS. 1 and 2 only with respect to the extensions 6", 6'" and the recesses 7", 7'". This embodiment offers the major advantage that the extension 6'" is heated on the turbine wheel 4 during the operation of the exhaust gas turbocharger and because of this expands, which leads to a pressing in and additional fixing in the recess 7'" of the sealing disc 5.

Figure 5:
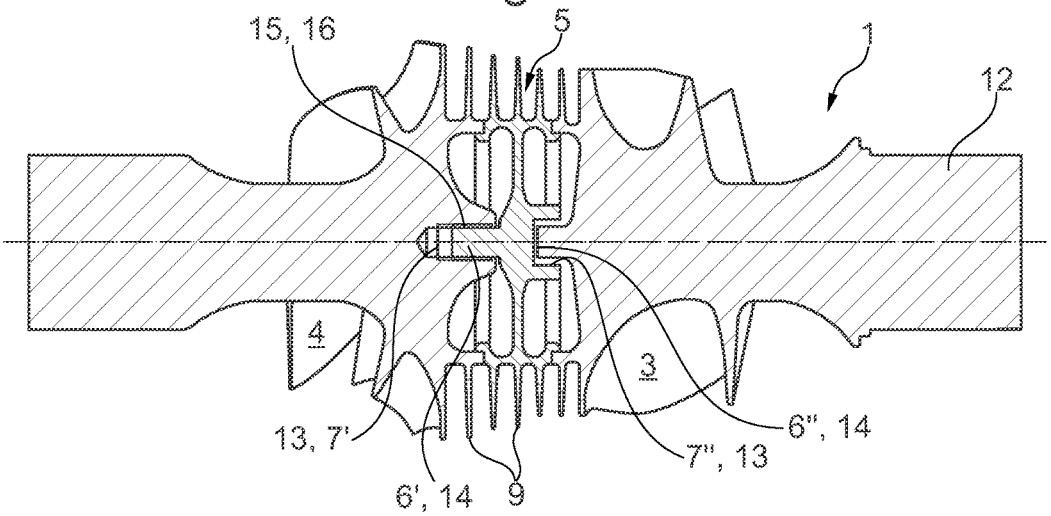

Looking at the embodiment of FIG. 5, it is evident that the sealing disc 5 comprises a central extension 6' on the turbine side and a central recess 7" on the compressor side and the compressor wheel 3 has an extension 6" designed complementarily thereto and the turbine wheel 4 has a recess 7' designed complementarily thereto and in addition are fastened to one another.

Figure 6:
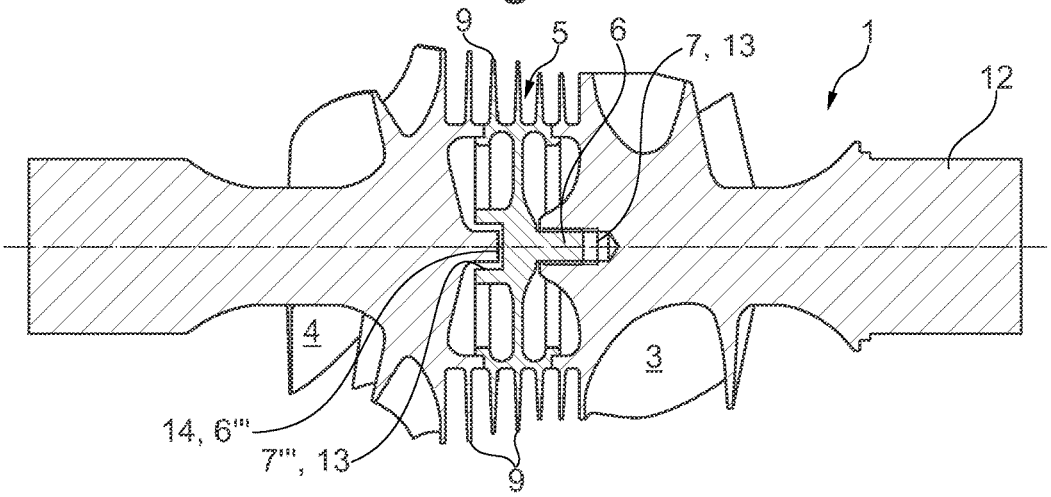

Looking at the embodiment of FIG. 6 the same is constructed conversely to FIG. 5, so that the sealing disc 5 has a central extension 6 on the compressor side and a central recess 7'" on the turbine side and the compressor wheel 3 has a recess 7 designed complementarily thereto and the turbine wheel 4 has an extension 6'" designed complementarily thereto and are thereby fastened to one another. This alternative is particularly favourable since on the turbine wheel 4 an extension 6'" and on the sealing disc 5 an associated recess 7'" and on the compressor wheel 3 a recess 7 and located opposite on the sealing disc an associated extension 6 are formed, so that the extension 6'" on the turbine wheel 4 during the operation of the exhaust gas turbocharger heats up and because of this expands, which leads to a pressing in and additional fixing in the recess 7'" of the sealing disc 5 and simultaneously transfers the heat to the sealing disc 5 and the extension 6 of the same facing the compressor wheel 3, so that said extension can expand and brace itself in the recess 7 on the compressor wheel 3.

Here, the extensions 6, 6', 6", 6'" can comprise an external thread 15 and the associated recess 7, 7', 7", 7'" an internal thread 16 designed complementarily thereto, so that the compressor wheel 3 can be screwed to the turbine wheel 4 via the sealing disc 5, as is shown according to FIG. 1. Analogously, this obviously applies also to the converse embodiment according to FIG. 4. Alternatively thereto, the extensions 6, 6', 6", 6'" can also be formed crowned or comprise a ball joint head 8, 8', as is shown according to FIGS. 2 and 3 and engage in the associated recesses 7, 7', 7", 7'" designed complementarily thereto. In this case, the recesses 7, 7' are formed in the manner of a joint socket.

Again alternatively, the extensions 6, 6', 6", 6'" can also be formed with oversize to the associated recesses 7, 7', 7", 7'" and are pressed into these. Here it is also conceivable purely theoretically that the extensions 6, 6', 6", 6'" and the associated recesses 7, 7', 7", 7'" do not have a rotation-symmetrical outer contour respectively inner contour but purely theoretically an angular outer contour or an angular contour that is formed complementarily thereto, as a result of which a torque transmission is possible in a particularly simple manner and in particular via a positively joined connection. Obviously it is also conceivable that the extension 6, 6" has an external thread and the recess 7, 7" an associated complementary internal thread, whereas the extension 6', 6'" has a ball joint head 8', as a result of which a combination of the connections from FIGS. 1 and 2 respectively from FIGS. 2 and 4 is possible.

Looking further at the FIGS. 1, 2 and 4 to 6, it is evident that the sealing disc 5 has annular sealing fins 9 which form a labyrinth seal. This is to prevent in particular a transfer of hot exhaust gas from the turbine wheel 4 in the direction of the compressor wheel 3. It is evident furthermore in the FIGS. 1 and 2 that the sealing disc 5 is connected in an annularly sealing manner to the turbine wheel 4 on the one side and the compressor wheel 3 on the other side. To this end, the sealing disc 5 has two annular steps 10 and 10' located opposite, wherein in one thereof the compressor wheel 3 engages with an annular edge 11, whereas the turbine wheel 4 with an annular edge 11' engages in the other annular step 10'.

On the whole, a connection of a turbine wheel 4 to a compressor wheel 3 can be achieved with the rotor 1 according to the invention even with a comparatively thick shaft 12, in particular provided a mounting of the shaft 12 on the end side is selected.

The invention claimed is:

1. A rotor of a supercharging device, comprising:

a compressor wheel and a turbine wheel arranged coaxially with the compressor wheel with respect to a rotation axis;

a sealing disc arranged axially between the compressor wheel and the turbine wheel, the sealing disc including a first axial side interfacing with the compressor wheel and a second axial side interfacing with the turbine wheel, wherein the sealing disc encloses a hollow space and defines a radial extent greater than an axial extent to facilitate sealing;

wherein the sealing disc is coupled on the first axial side to the compressor wheel and on the second axial side to the turbine wheel at respective connections, the respective connections each including a holding contour engaged with a counter-holding contour, wherein the holding contour is a central recess and the counter-holding contour is a centrally projecting extension; and wherein the respective connections are disposed in the hollow space axially between the compressor wheel and the turbine wheel and secure the compressor wheel, the sealing disc and the turbine wheel to one another.

2. The rotor according to claim 1, wherein the central recess and the centrally projecting extension extend axially to the rotation axis.

3. The rotor according to claim 1, wherein:

the compressor wheel and the turbine wheel each include the central recess, which respectively face one another, the sealing disc includes centrally projecting extensions on the first side and on the second side, respectively, the centrally projecting extensions on the first side and the second side of the sealing disc respectively engaging the corresponding central recess of the compressor wheel and the turbine wheel to secure the compressor wheel, the sealing disc and the turbine wheel to one another.

4. The rotor according to claim 1, wherein:

the compressor wheel and the turbine wheel each include the centrally projecting extension, which project in a direction towards one another, the sealing disc includes central recesses on the first side and the second side, respectively, wherein the central recesses on the first side and the second side of the sealing disc respectively receive the corresponding centrally projecting extension of the compressor wheel and the turbine wheel to secure the compressor wheel, the sealing disc and the turbine wheel to one another.

5. The rotor according to claim 1, wherein:

the first side and the second side of the sealing disc respectively include one of the centrally projecting extension and the central recess, the compressor wheel includes another of the centrally projecting extension and the central recess corresponding to the first side of the sealing disc, and the turbine wheel includes another of the centrally projecting extension and the central recess corresponding to the second side of the sealing disc to secure the compressor wheel, the sealing disc and the turbine wheel to one another.

6. The rotor according to claim 1, wherein the sealing disc further includes a plurality of annular sealing fins disposed on a radially outer side with respect to the hollow space to provide a labyrinth seal.

7. The rotor according to claim 1, wherein the centrally projecting extension of the respective connections has an external thread and the central recess associated therewith has a complementary internal thread, so that the compressor wheel is configured to be screwed to the turbine wheel via the sealing disc.

8. The rotor according to claim 1, wherein the centrally projecting extension of the respective connections defines at least one of a crowned head and a ball joint head, which engage in the central recess associated therewith having a profile complementary thereto.

9. The rotor according to claim 1, wherein the centrally projecting extension of the respective connections is pressed into the central recess associated therewith.

10. The rotor according to claim 1, wherein the sealing disc is annularly and sealingly connected to the turbine wheel and the compressor wheel.

11. The rotor according to claim 1, wherein the sealing disc further includes at least two annular steps disposed axially opposite one another on the first side and the second side, respectively, wherein the compressor wheel engages at least one annular step on the first side via a first annular edge, and the turbine wheel engages another annular step on the second side via a second annular edge.

12. A supercharging device, comprising:

a rotor including a compressor wheel having a first face end, a turbine wheel having a second face end and a sealing disc arranged axially between the compressor wheel and the turbine wheel with respect to a rotation axis, the sealing disc enclosing a hollow space and having a first axial side interacting with the first face end of the compressor wheel and a second axial side interacting with the second face end of the turbine wheel;

the first face end of the compressor wheel having one of a first holding contour and a first counter-holding contour and the first axial side of the sealing disc having another of the first holding contour and the first counter-holding contour;

the second face end of the turbine wheel having one of a second holding contour and a second counter-holding counter and the second axial side of the sealing disc having another of the second holding contour and the second counter-holding contour;

wherein the first holding contour and the second holding contour each define a recess, and the first counter-holding contour and the second contour-holding contour each define an axially projecting extension;

wherein the compressor wheel is fastened to the turbine wheel via a first interlocking connection disposed in the hollow space between the first holding contour and the first counter-holding contour, and a second interlocking connection disposed in the hollow space between the second holding contour and the second counter-holding contour; and wherein the sealing disc defines a radial extent greater than an axial extent to facilitate sealing a fluid flow in an axial direction of the rotation axis.

13. The supercharging device according to claim 12, wherein the first interlocking connection and the second interlocking connection are disposed centrally in the hollow space.

14. The supercharging device according to claim 12, wherein the first face end of the compressor wheel and the second face end of the turbine wheel respectively include the recess, the recess of the first face end arranged to face towards the recess of the second face end; and the sealing disc includes the axially projecting extension on the first axial side engaged with the recess of the first face end and on the second axial side engaged with the recess of the second face end to secure the compressor wheel, the sealing disc and the turbine wheel to one another.

15. The supercharging device according to claim 12, wherein the first face end of the compressor wheel and the second face end of the turbine wheel respectively include the axially projecting extension, which project towards one another; and the sealing disc includes the recess on the first axial side engaged with the axially projecting extension of the first face end and on the second axial side engaged with the axially projecting extension of the second face end to secure the compressor wheel, the sealing disc and the turbine wheel to one another.

16. The supercharging device according to claim 12, wherein one of the first face end of the compressor wheel and the second face end of the turbine wheel includes the recess, and another of the first face end and the second face end includes the axially projecting extension; and wherein the first axial side of the sealing disc includes a corresponding one of the recess and the axially projecting extension interacting with the first face end, and the second axial side includes a corresponding one of the recess and the axially projecting extension interacting with the second face end.

17. The supercharging device according to claim 12, wherein the sealing disc further includes a plurality of annular sealing fins, which define a labyrinth seal.

18. The supercharging device according to claim 12, wherein the sealing disc is annularly and sealingly connected to the turbine wheel and the compressor wheel.

19. The supercharging device according to claim 18, wherein the sealing disc further includes at least two annular steps disposed axially opposite one another with respect to an axis of rotation;

wherein the first side of the compressor wheel engages one of the at least two annular steps via a first annular edge and the second side of the turbine wheel engages another of the at least two annular steps via a second annular edge.

20. A rotor for a supercharging device, comprising:

a compressor wheel having a first face end, the first face end defining a central recess;

a turbine wheel having a second face end facing towards the first face end of the compressor wheel, the second face end defining a central recess;

a sealing disc disposed axially between the compressor wheel and the turbine wheel with respect to an axis of rotation, the sealing disc enclosing a hollow space and including a first axially projecting extension engaging into the central recess of the first face end and a second axially projecting extension engaging into the central recess of the second face end;

wherein the compressor wheel and the turbine wheel are fastened to one another at a first interlocking connection disposed in the hollow space between the first axially projecting extension of the sealing disc and the central recess of the first face end of the compressor wheel, and at a second interlocking connection disposed in the hollow space between the second axially projecting extension of the sealing disc and the central recess of the second face end of the turbine wheel; and wherein the sealing disc defines a radial extent greater than an axial extent to facilitate sealing a fluid flow in an axial direction of the rotation axis.

* * * * *